United States Patent [19]

Peterson et al.

[11] 4,361,069

[45] Nov. 30, 1982

[54] ELECTRONICALLY CONTROLLED SWELL SHUTTER OPERATOR FOR PIPE ORGANS

[75] Inventors: Richard H. Peterson, 11748 Walnut Ridge Dr., Palos Park, Ill. 60464; James A. Mornar, Crestwood, Ill.

[73] Assignee: Richard H. Peterson, Palos Park, Ill.

[21] Appl. No.: 189,999

[22] Filed: Sep. 23, 1980

[51] Int. Cl.[3] ..... G10B 3/16

[52] U.S. Cl. ..... 84/346; 84/DIG. 19

[58] Field of Search ..... 84/346, 372, DIG. 19; 318/663, 624, 612, 592; 250/211 K

[56] References Cited

U.S. PATENT DOCUMENTS

| | | | |
|---|---|---|---|
| 500,040 | 6/1893 | Skinner . | |
| 2,005,643 | 6/1935 | Willis et al. | 84/347 |
| 2,072,844 | 3/1937 | Austin . | |
| 3,043,998 | 7/1962 | Lunn et al. | 318/663 |
| 3,495,145 | 2/1970 | Sordello et al. | 318/663 |
| 3,513,247 | 5/1970 | Anderson et al. | 84/DIG. 19 |
| 3,701,833 | 10/1972 | Bosche, Jr. | 84/346 |
| 3,736,486 | 5/1973 | Gould et al. | 318/624 |
| 3,749,997 | 7/1973 | Cohen et al. | 318/592 |
| 3,995,208 | 11/1976 | Parr | 318/612 |
| 4,216,422 | 8/1980 | Divjak et al. | 318/612 |

*Primary Examiner*—J. V. Truhe

*Assistant Examiner*—Forester W. Isen

*Attorney, Agent, or Firm*—Jones, Tullar & Cooper

[57] ABSTRACT

An electronically controlled swell shutter operator for pipe organs includes an electric motor driving a speed reducer whose output is connected to move the shutters of a pipe organ swell chamber, in order to control the volume of sound heard by the listeners. A swell pedal controlled by the organ player operates a first potentiometer and establishes a first voltage of a given polarity, the magnitude of which represents the exact position that the shutters should be in. The output of the speed reducer operates a second potentiometer which establishes a second voltage of a polarity opposite to that of the swell pedal potentiometer, the magnitude of this second voltage being dependent on the position of the swell shutters. A system of integrated circuit comparators compares the above-mentioned first and second voltages to produce an error signal. A logic system responds to the comparison result to cause the shutters to move in a desired direction and at a suitable speed to reduce the error and to achieve a balance, whereby the swell shutters assume a position corresponding to the position of the swell pedal. Dynamic braking and a system of automatically adjustable dead bands prevents overshoot and hunting.

16 Claims, 6 Drawing Figures

REVERSE CIRCUIT TRANSISTOR
MOTOR ENABLE TRANSISTOR
SLOW SPEED TRANSISTOR
OPENING DEADBAND ADJUST
CLOSING DEADBAND ADJUST
-12 VOLTS
+12 VOLTS
CAM POSITION SENSOR

TO ORGAN +
+12 VOLT
-12 VOLT
SECONDARY
PRIMARY
ORGAN RECTIFIER -
ORGAN RECTIFIER -
ORG ORG
A B C D
SLOW SPEED
REVERSE
MOTOR ENABLE
ORG +
ORG +
ORG +
35
80
81
82
83
84
85
86
88
89
92
93
96
97
98
99
100
101
102
103
131
135
136
137
138
139
140
141
142
154
155
156
157
158
160
161
162
182
183
184
185
187
188
189
190
40
11
1
2
3

ELECTRONICALLY CONTROLLED SWELL SHUTTER OPERATOR FOR PIPE ORGANS

BACKGROUND OF THE INVENTION

The present invention relates, in general, to pipe organs, and more particularly to a system for electronically positioning the volume-controlling shutters for a pipe organ swell chamber.

In pipe organs the various tones are derived from wind blown pipes. Each pipe is capable of sounding at only a single intensity (volume) level; and if an attempt is made to control the loudness, as for example by changing the air pressure, an unacceptable variation in tuning will result. In order to surmount this limitation, it is customary in a pipe organ to place the pipes of at least some of the divisions of the organ in a box or room called a (swell box or swell chamber) separated from the main listening room by a set of moveable shutters (sometimes called shades). When closed, these shutters effectively close off the chamber from the listening room and substantially attenuate the sound that is heard. A swell pedal (or swell shoe) is provided at the console and can be adjusted to several positions for controlling the extent that the shutters are opened. Patents that relate to swell shutters and swell boxes include U.S. Pat. Nos. 500,040 issued to E. M. Skinner in 1893, and 2,005,643 issued to H. Willis et al. in 1935.

In early swell devices the shutters were mechanically linked to the swell pedal by means of operating rods or cables. With the development of electrically controlled key actions it became common to place the console at a remote location from the chambers, and it became difficult to arrange the necessary mechanical linkage to the swell chamber shutters. The next step was the development of electrically controlled pneumatic swell shutter operators, an example of which is shown in U.S. Pat. No. 2,072,844. Such pneumatic devices have been employed for decades and have been reasonably successful; however they have many limitations, the most important of which is their large size. Pipe organs operate on low wind pressures, and in order to achieve sufficient force to move the relatively heavy shutters with promptness, operating pneumatics of great bulk are necessary. In past decades wind pressures of up to 15 inches water gauge were commonly used. This is in fact a relatively low pressure (about one-half pound per square inch), and created problems in driving prior swell shade operators. However, the problem of rapidly and accurately moving swell shade operators is now greatly exacerbated by the current trend back to the very low pressures used in early organs, where the pipes speak on pressures in the order of one and one-half ($1\frac{1}{2}$) or two (2) inches water gauge.

Attempts have been made to make electric motor-driven swell shutter operators, but none have been very successful because of one or more of the limitations of cost, size or lack of precision in operation. An example of such an operation is found in U.S. Pat. No. 3,701,833. A successful swell operator must move the shutters promptly, but precisely, without hunting, and without slamming as the shutters close. In addition it must be easily adaptable to a wide range of shutter sizes and weights, and must be easily adjustable to produce a smooth swell, whereby the loudness of sound heard varies uniformly from soft to loud as the swell shoe is moved from closed to open.

SUMMARY OF THE INVENTION

It is, therefore, an object of the present invention to provide a swell shutter operator which does not require air pressure for operation, which is quiet, reliable, and accurate, and which can be operated from a remotely located organ console.

Briefly, in accordance with the present invention, the swell shutters of an organ are driven by an electric motor connected to a speed reducer mechanism. Alternatively, the connections to the shutters can be made by a cable together with a spring or weight return, or by other suitable connectors. A conventional swell pedal having either stepped contacts or a continuously variable resistive element is adapted to be operated by the organist's foot in the usual fashion. A first variable potentiometer, either in the form of a continuously variable potentiometer or in the form of a resistor network, forms a voltage divider which delivers an output voltage of a first given polarity, for example positive, the magnitude of which is a function of the position of the swell shoe. Associated with the output shaft of the speed reducer is a cam operated second potentiometer which in its preferred form is a photoelectric potentiometer comprising a moveable light emitting diode and a photo resistor mounted in a light tight tube. As the output shaft moves, the resistance of the photocell changes as the light emitting diode is moved closer or farther away from the photo resistor by means of a cam attached to the output shaft. This second potentiometer is connected to a source of potential of a second polarity, for example negative, so that its output is a negative voltage the magnitude of which represents the position that the shutters are in at any given moment.

An electronic system of integrated circuit comparators is connected to the outputs of the two potentiometers. The comparators compare the positive voltage from the swell shoe potentiometer, which indicates the position that the organist wishes the shutters to be in, to the negative voltage from the second potentiometer, which represents the actual position of the output shaft, and thus the shutter. These positive and negative voltages must be accurately regulated to insure proper control of the shutters, and thus they are obtained from an inverter circuit, followed by solid state voltage regulators which stabilize the voltage to a high degree of accuracy. The electronic logic circuitry responds to the two input voltages and decides what action to take. In the event of an imbalance between the voltages it will pull in an "enable" relay which enables the motor to start and to move the shutters so that balance can be achieved. A second relay controlled by the logic system simultaneously tells the motor whether a forward or a reverse motor direction is required to correct the imbalance. A third relay adjusts the speed of the motor so that when only a small imbalance is sensed, the motor will run at a relatively slow speed, while if the imbalance is great the motor will run at a faster speed. Whenever the motor is not running, the enable relay drops out, and additional, normally shorted contacts on the relay cause the motor to be short circuited to provide dynamic braking, which stops the motor in only a few revolutions.

In spite of the fact that the motor brakes quickly once balance has been achieved, because of inertia in the mechanical system, it obviously is not possible for the motor to stop in "zero" time, and some degree of overshoot, therefore, is inevitable. To prevent this overshoot from causing "hunting" in the motor, and thus causing the shutters to oscillate about the desired position, dead bands are provided in the comparator circuits to prevent operation of the balancing circuit. Thus, balance need not be absolutely perfect, but need only be "close enough" as determined by the dead band adjustments.

Since the amount of overshoot is partly a function of how fast the motor is running, automatic means are provided for widening the dead bands whenever the system is in high speed operation, and for causing the dead bands to be narrower when the system is running slowly. There are several reasons for this action to be designed into the system. One is that the need for precise balance is only important when the shutters are near their closed positions. In this range even slight differences in shutter position make a noticeable difference in the sound level heard by the listener, and hence it is important that the shutters assume substantially the same positioning every time the swell shoe is moved into one of the near closed positions. Further, when the shutters are near the closed position, it is important that the motor run at its slow speed to prevent slamming of the shutters as they approach their fully closed position, or to avoid unnatural abruptness as they move toward a slightly opened position from the fully closed position.

In order to accomplish these objectives the logic system senses the magnitude of the error between the two potentiometer voltages, the position of the shutters, and the direction in which they are moving, and then operates the three relays in such a manner as to control the system to produce all of the desired objectives.

The electric motor that drives the system is preferably a DC motor, and it is an important advantage that it operates on the low voltage organ power supply that is a part of all electrically operated pipe organs. Such power supplies are commonly known in the trade as "rectifiers" and usually range in voltage between about 12 volts and 15 volts. The use of the organ power supply for this purpose avoids the need for extra power line wiring, and results in substantial savings in the installation costs of the swell shutter operator.

As previously mentioned, the sizes and weights of swell shutters vary markedly in different organs as does the friction involved in such systems. Thus, the exact nature of the linkage used to drive the shutters (shades) may vary with different installations. In some cases a direct linkage from the speed reducer output shaft is appropriate, while in other cases operation by means of a cable and pulley arrangement is more practical. In the latter case, the swell shade operator of the invention can be arranged to pull the shutters open or to pull them closed, with the force required to return the shades to the opposite positions being supplied by a spring or weight system. When these latter systems are used, it is clear that the load seen by the motor will be different depending upon whether the spring or weight is pulling against the direction of the motor, or is helping to accelerate the motor. Because of this, various adjustments are provided to control the speed of the motor independently when it is moving in the opening or in the closing directions. In addition, other adjustments permit the overall motor speed to be adjusted according to the load imposed upon it, and according to the voltage of the organ rectifier to which the system is connected.

BRIEF DESCRIPTION OF THE DRAWINGS

The foregoing and additional objects, features and advantages of the present invention will become apparent to those of skill in the art from the following detailed description of a preferred embodiment, taken in conjunction with the accompanying drawings, in which.

DESCRIPTION OF THE PREFERRED EMBODIMENT

Figure 1:
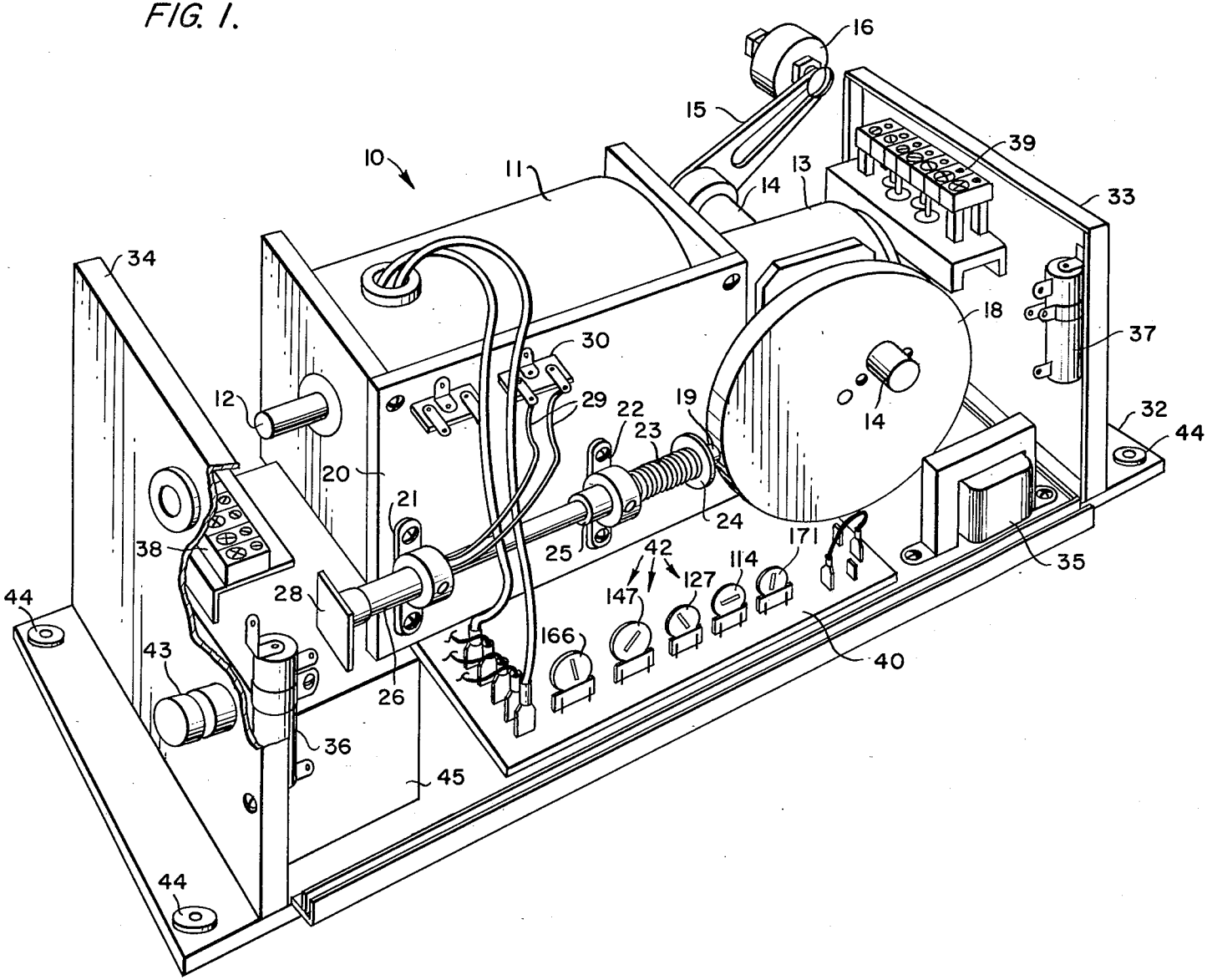
FIG. 1 is a perspective view of a swell shutter operator according to the invention.

Referring to the drawings, FIG. 1 is a perspective view of a preferred form of the swell shutter operator 10 of the invention. As illustrated, the operator incorporates a DC electric motor 11 having an output shaft 12 connected to a speed reducer 13. The speed reducer has an output shaft 14 to which is connected a crank arm 15, the outer end of which carries a connector 16 for use in connecting the output of the swell shutter operator to the shutters, or shades, of a swell chamber (not shown). The speed reducer is a conventional gear mechanism which reduces the speed of rotation of motor shaft 12 by about 50 to 1 and causes the output crank arm 15 to rotate either in a clockwise or a counterclockwise direction, as viewed in FIG. 1, depending upon the polarity of the voltage supplied to the motor.

Also connected to the output shaft 14 of the speed reducer is a position indicator cam 18 which is connected to the shaft by a suitable set screw and which is shaped to produce from a potentiometer to be described a voltage which corresponds to the rotational position of shaft 14. A cam follower 19 is secured to and supported by a wall 20 which forms a part of a housing for motor 11, the cam follower being held in position by suitable brackets 21 and 22. A coil spring 23 surrounds cam follower 19 and is mounted between bracket and a flange 24 on a first, contact end of the cam follower so that the spring presses the cam follower into contact with the camming surface of cam 18. A suitable bearing 25 is mounted within bracket 22 to hold the cam follower so that as the cam 18 rotates, the cam follower 19 slides laterally through the bearing 25.

The second end of the cam follower opposite to the contact end and spaced from cam 18, passes through bracket 21 and rides in a tube 26 secured to the bracket. The cam follower fits snugly in the near end of tube 26 so that ambient light does not enter, the distal end of the tube being closed by a photocell housing 28 mounted on the tube. The photocell is exposed to the interior of tube 26, and the end of the cam follower carries a light emitting diode (not shown) which is connected by leads 29 to a terminal block 30. The light emitting diode rides in tube 26 with the cam follower 19, sliding back and forth in a horizontal direction as viewed in FIG. 1 as the output shaft 14 rotates, and moving toward and away from the photocell.

The photocell 28 is a photoresistor whose resistance varies as a function of the light intensity impinging on its surface. Because the photocell is exposed only to the interior of tube 26, the intensity of the received light is a function of the distance between the light emitting diode carried on the end of the cam follower and the surface of the photoresistor 28. Thus, the cam follower arrangement provides a varying light intensity at the photocell and produces a varying output voltage from the photocell which corresponds to the rotation of shaft 14, and thus to the position of crank arm 15 and the corresponding position of the swell chamber shutters connected thereto.

The motor 11 and speed reducer 13 are mounted on a base plate 32, with upstanding end plates 33 and 34 and a suitable cover (not shown) completing the swell shutter operator housing.

Mounted within the swell shutter operator housing is an inverter transformer 35, resistors 36 and 37, and terminal strips 38 and 39 which facilitate connecting the unit into an organ system, and also facilitate adjustment of the unit for proper operation under various conditions of service. A main electronic circuit board assembly 40 is mounted on base 32 and contains the logic and control systems for the motor 11. A series of potentiometers generally indicated at 42 are mounted on the circuit board so as to permit adjustment of individual electronic logic circuits to be described hereinafter. A fuse 43 protects the system from damage due to the failure of any components, and mounting gromets 44 in the base plate 32 are for the purpose of mounting the complete unit to a wall or floor location which permits mechanical connection of the unit to the shutter assembly and electrical connection to the organ console.

A relay housing 45 encloses the various relays to be described in connection with the circuit diagram of FIG. 3, and provides acoustic isolation so that the operation of the relays is not heard.

Figure 2:
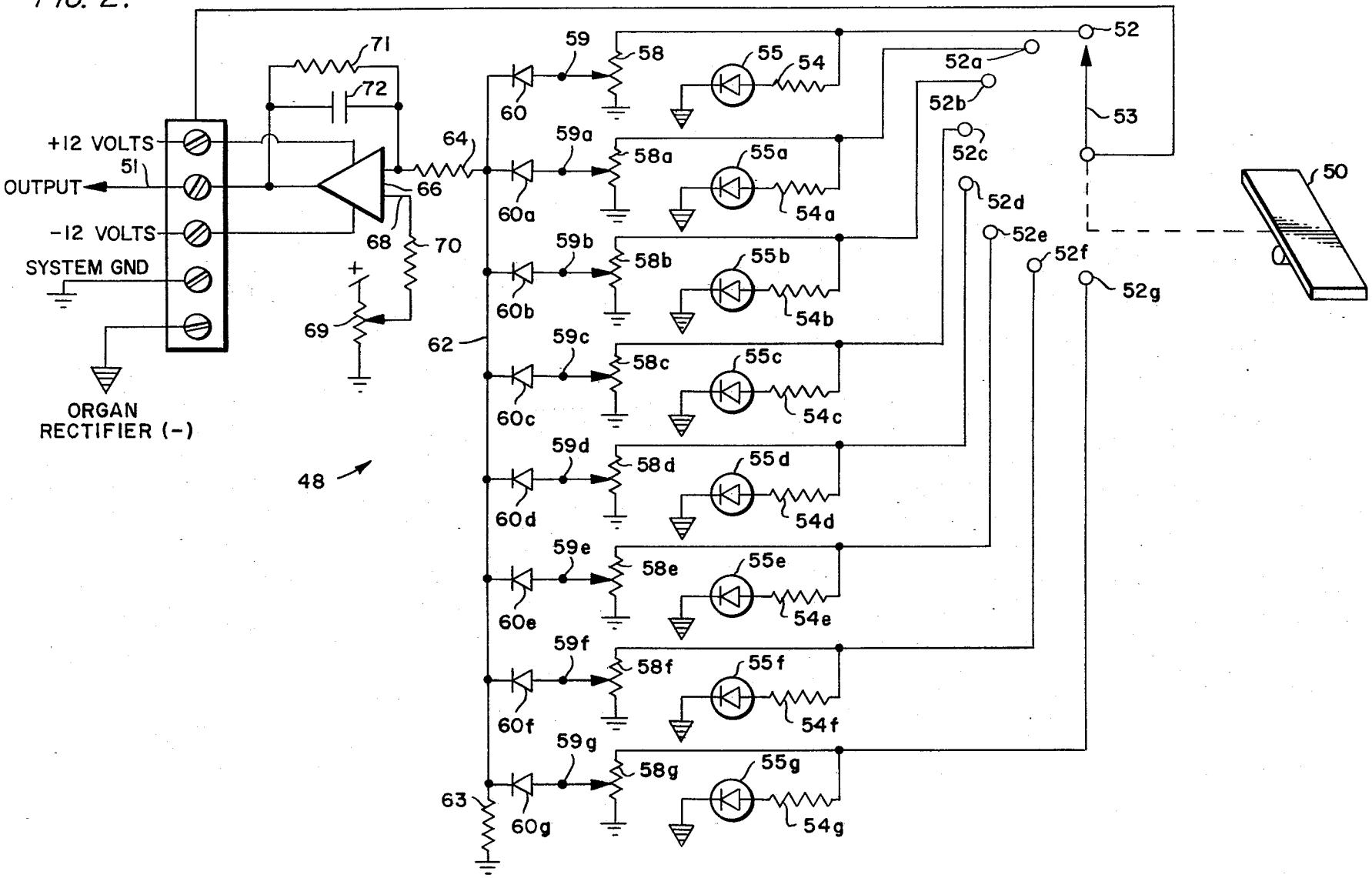
FIG. 2 is a schematic circuit diagram of the swell shoe potentiometer circuit board assembly.

A more detailed description of the system which has been outlined in the foregoing discussion of FIG. 1 will now be given in connection with the description of the schematic diagrams of FIGS. 2 and 3. FIG. 2 is a schematic circuit diagram of a position adjust board generally indicated at 48. This is a separate sub-assembly which is customarily mounted at the organ console, and is connected to the conventional organ swell pedal 50 to function essentially as an adjustable potentiometer for producing an output signal at line 51, the magnitude of which represents the position of the swell pedal 50. The conventional pipe organ swell pedal consists of a number of contacts, 52, 52*a*, 52*b* . . . 52*g* which usually are in the form of silver wires that are sequentially contacted by a rotor shown schematically at 53. The rotor and contacts comprise a rotary switch which, in the position shown, correspond to a swell pedal location which requires the swell chamber shutters to be closed. As the pedal 50 is depressed by the organist's foot, the switch rotor 53 sequentially engages the contacts until it reaches contact 52*g*, which corresponds to the full open condition for the swell shutters. Each of these switch positions is connected to a lamp circuit which includes a resistor 54 and a light emitting diode 55. The purpose of these lamp circuits is to indicate in what position the swell shoe is located, so that the adjustment procedures for the shutter operator system can be carried out in an orderly fashion. Also connected to each switch position in parallel with the foregoing lamp circuits is a potentiometer 58 for establishing at its output terminal 59 a potential which is determined by the potentiometer adjustment. Each of the output terminals 59 is connected by means of a corresponding diode 60 to an output buss 62, upon which will appear a voltage corresponding to the setting of the potentiometer 58 which is contained in the circuit connected to the contact selected by switch arm 53. If a shorting type switch is used, the voltage on buss 62 will be the highest voltage to which any of the simultaneously activated potentiometers 58 is adjusted.

Buss 62 is connected through load resistor 63 to ground, and through resistor 64 to the input of an operational amplifier 66, which is conventional, and which may be a National Semiconductor type LM741. This operational amplifier and its related circuitry acts as a level translator and produces at its output 51 a negative voltage, the magnitude of which will indicate the position of the swell pedal 50. The operational amplifier is connected in an inverting configuration, and accordingly the positive voltage connected to the rotor arm 53 is converted to a negative voltage. Bias to the non-inverting input terminal 68 of the amplifier 66 is supplied by an adjustable potentiometer 69 which is adjusted to reference the output voltage from the operational amplifier on line 51 with respect to common ground. Resistor 71 and capacitor 72 provide negative feedback around the operational amplifier for stable operation.

In setting up the swell shutter operator for use with a pipe organ, the potentiometers 58 through 58*g* are individually adjusted to determine the exact extent of the swell shutter opening desired for each position of the swell pedal 50. The proper adjustment of these potentiometers would be such as to produce at the output terminals 59 through 59*g* progressively higher output voltages at each step as the pedal is moved from its closed position to its open position. The output signal on line 51 thus will be a voltage the magnitude of which represents the position that the swell shutters are to be in at any given setting of the pedal 50. This signal provides one input to the comparator system to be described, while the second input signal is produced by the cam position sensor described with respect to FIG. 1; i.e., the output from photocell 28.

Figures 3A, 3B, 3C:
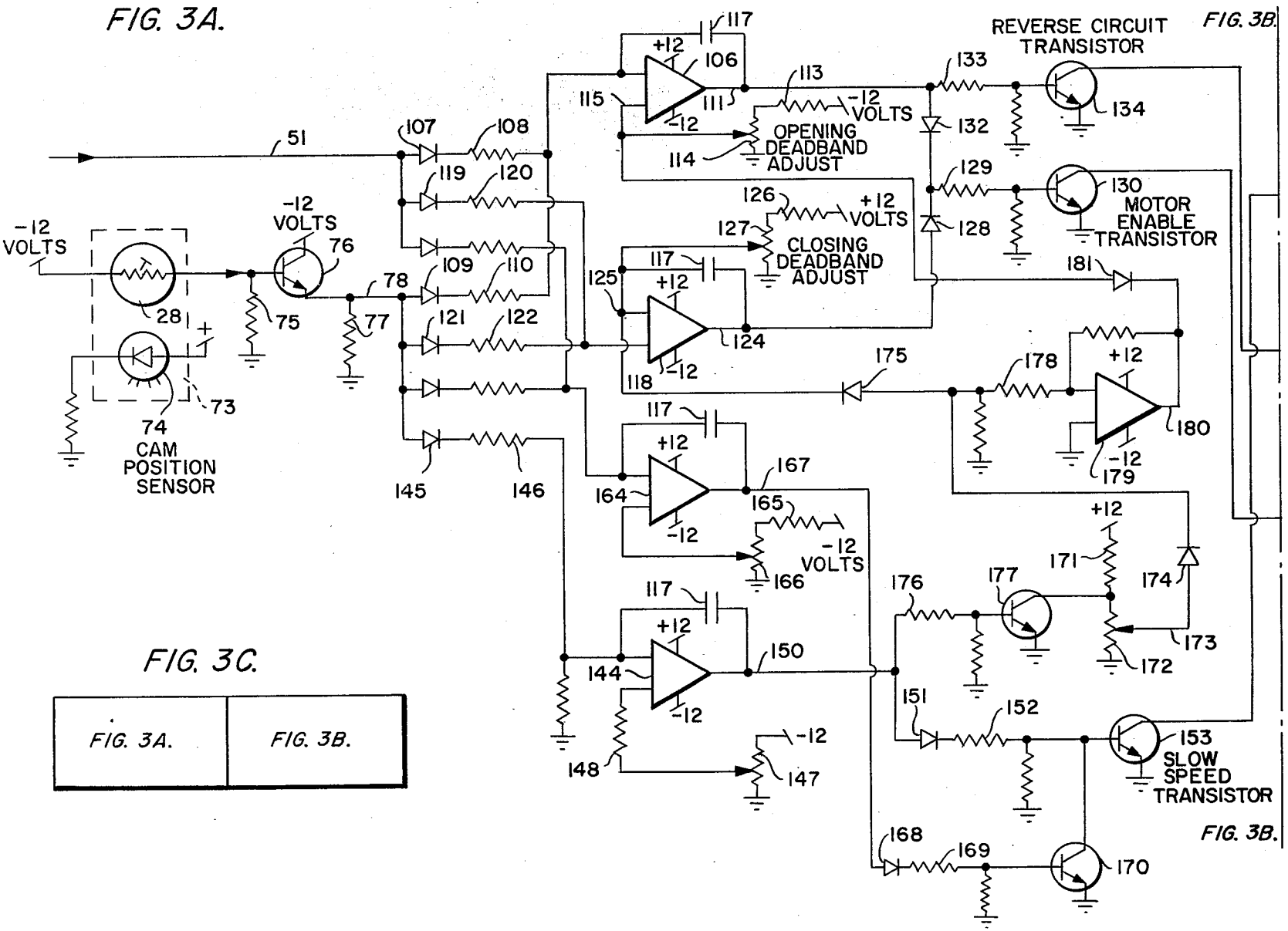
FIG. 3 is a schematic circuit diagram of the swell shade operator of FIG. 1.
Figures 3A, 3B, 4:
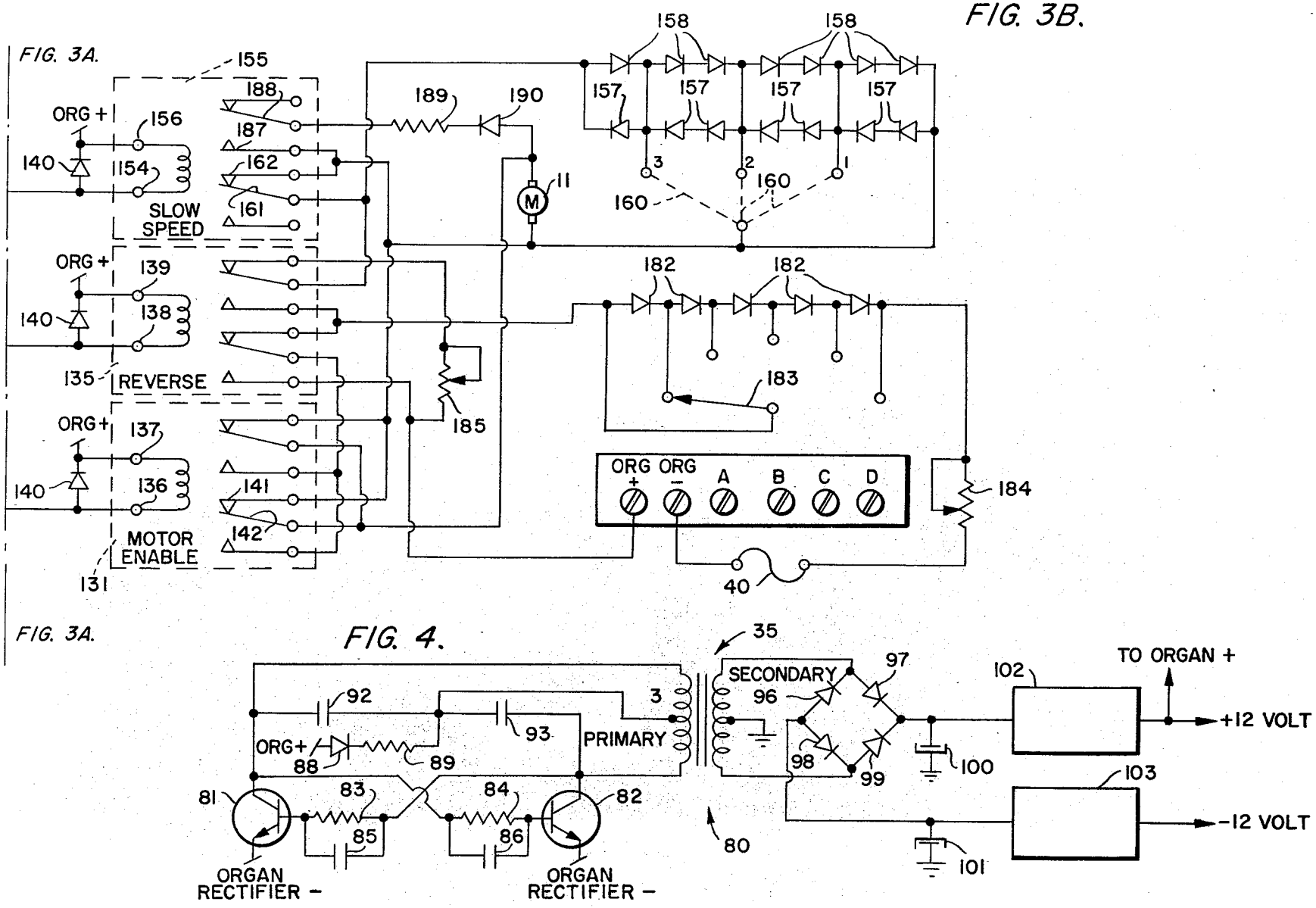
FIG. 4 is a schematic diagram of an inverter circuit for use in the present invention.

Referring now to FIG. 3, which is a schematic diagram of the logic circuit for operating the swell shutter operator of FIG. 1, there is illustrated a first input line 51 which receives the output from the position adjust board 48 just described. A second input is provided by a cam position sensor 73 which includes a light emitting diode 74 and the photoresistor 28, the light emitting diode being mounted on the cam follower 19 as described above with respect to FIG. 1. As previously described, as the lamp 74 is moved closer to or further away from the photoresistor 18, its resistance changes. Photoresistor 18 is connected to a resistor 75 to form a voltage divider, the junction of resistors 18 and 75 being connected to the base of an emitter follower transistor 76. Substantially the same voltage appears across the load resistor 77 of transistor 76 which provides a low impedance source for driving the various comparator circuits to be described. The purpose of the comparators and logic system of this figure is to compare the voltage from the position adjust board 48 that appears on line 51 with the output from the cam position sensor which appears across load resistor 77 on line 78, and to control the shutter drive motor 11.

It is important that the DC bias voltage (plus or minus 12 volts) supplied as DC input voltages to the swell pedal switch 53 (FIG. 2) and to the photoresistor 18 be very stable and well regulated. In a preferred system, these voltages are obtained from the organ rectifier by means of an inverter circuit generally indicated at 80 and illustrated in FIG. 4. Referring now to this figure, the inverter circuit includes a multivibrator comprised of transistors 81 and 82, resistors 83 and 84, and capacitors 85 and 86. Power to this circuit is provided by the organ rectifier (not shown), the positive terminal of which is connected through diode 88 and resistor 89 to the center tap of the primary winding of the inverter transformer 35. The outer ends of the transformer primary winding are connected to the collectors of transistors 81 and 82 so that as the multivibrator circuit oscillates at a frequency determined by the value of capacitors 92 and 93, the transistors 81 and 82 alternately switch the ends of the transformer winding to the minus terminal of the organ rectifier through the emitter connections of the respective transistors. This switching of the transformer primary connections produces an AC current in the primary winding which is transformed to the secondary winding. The secondary winding is also center tapped, and is connected at its outer ends to a rectifier circuit comprised of diodes 96, 97, 98 and 99 which produce positive and negative DC voltages across capacitors 100 and 101, respectively. These voltages are applied to the integrated circuit regulators 102 and 103, respectively, which regulate and stabilize these voltages which then appear at the plus 12 and minus 12 volt terminals. The positive voltage regulator may be an LM340+12 and the negative regulator may be an LM320−12 both manufactured by the National Semiconductor Corporation.

Referring again to FIG. 3, 106 is a comparator, which may be made from an integrated circuit operational amplifier such as the LM741 previously mentioned. All of the comparators to be described hereinafter are made from this same type integrated circuit. The comparator 106 receives two input voltages, one of which is from the swell shoe potentiometer, whose voltage output appears on line 51, and which is connected through diode 107 and resistor 108. The second input signal is from the cam position sensor 48, which appears on line 78, and is connected to the input of the comparator through diode 109 and resistor 110. These input voltages are compared, and if the negative voltage from the cam position sensor 73 is of greater magnitude than the positive voltage from the swell (or expression) shoe potentiometer 48, the comparator 106 will produce a positive voltage at its output terminal 111. Accordingly, this comparator is called the "negative imbalance sensor".

Resistor 113 and potentiometer 114 are a bias network that biases the non-inverting input terminal 115 of the comparator to a slight negative voltage as adjusted by potentiometer 114. The purpose of this circuit is to produce a dead band, for the purpose previously described, wherein the amount of negative imbalance must be above a minimum threshold as set by potentiometer 114 in order for the negative imbalance to be recognized as significant enough to cause the circuitry to correct the imbalance by moving the swell shutters. Capacitor 117 is used to prevent parasitic oscillation of the comparator circuit.

Comparator circuit 118 is similar to that just described, except that the inverting and non-inverting inputs are reversed. The input signal from line 51 is through diode 119 and resistor 120, and the input signal from line 78 is through diode 121 and resistor 122. This comparator produces a positive voltage on line 124 whenever a positive imbalance occurs, provided that the positive imbalance is greater than the off-set voltage applied to terminal 125 as determined by the resistor 126 and the potentiometer 127, which provide positive dead-band adjustment. This might also be called the "closing dead-band adjustment", because whenever the imbalance at the input of this comparator is positive, it means that the shutters are to be moved in the closing direction in order to correct the imbalance. In like manner, the potentiometer 114 previously described can be properly characterized as the "opening dead-band adjustment" control. Thus we see that if there is either a positive or a negative imbalance between the cam position sensor voltage and the swell shoe potentiometer voltage, and if the imbalance is greater than the off-set dead-band adjustment voltage, then one or the other of the comparators 106 or 118 will produce a positive voltage at its output.

A positive output on line 124 from comparator 118 is applied through diode 128 and resistor 129 to the base of a motor enable transistor 130. The collector of transistor 130 is connected to the operating coil of a motor enable relay 131. A positive voltage at the output of comparator 106 is also applied to the same transistor 130 input via diode 132 and resistor 129. However, whenever there is a positive voltage at the output 111 of comparator 106, this voltage is also applied through resistor 133 to the base of reverse circuit transistor 134, the collector of which is connected to the operating coil of a reverse relay 135. When the motor enable transistor 130 is switched on, the coil terminal 136 of relay 131 is connected through the transistor to the organ rectifier (−), and since terminal 137 of this coil is connected to organ rectifier (+), this relay will pull in and start the motor 11. Whenever the output of comparator 106 is positive, the reverse circuit transistor 134 conducts and connects the terminal 138 of the reversing relay 135 to organ rectifier (−). Since the opposite terminal 139 is permanently connected to organ rectifier (+), the reversing relay 135 will also pull in, reversing direction of the current through the motor and causing it to run in the reverse direction. The diodes 140 across the relay coils are protective diodes to prevent strong transient voltages, that would otherwise arise due to the collapsing magnetic fields around the coils, from causing damage to the various switching transistors.

Whenever the motor enable relay 131 is in its unenergized condition, there is a short circuit placed across the motor 11 by means of the contacts 141 and 142 of this relay. This is for the purpose of providing dynamic braking, for with the motor short-circuited, it will stop rotating very quickly. This is important to minimize hunting, and to enable precision operation of the system.

Unlike the other comparators in this system, comparator 144 has only a single input, which is from line 78 through diode 145 and resistor 146. A potentiometer 147 establishes an off-set voltage which is applied through resistor 148 to the non-inverting input of the comparator. It should be remembered that the voltage at point 78 is always a negative voltage and that the magnitude of the voltage is a function of the position of the cam position sensor, which is in turn a function of the position of the swell shutters. Whenever this negative voltage exceeds the threshold set by potentiometer 147, comparator 144 produces an output at line 150, and this positive voltage is applied through diode 151 and resistor 152 to the base of a slow speed transistor 153, the collector of which is connected to a terminal 154 of a slow speed relay 155. Conduction of transistor 153 connects terminal 154 to organ rectifier minus, and since terminal 156 of the relay is always connected to organ rectifier (+), the relay will pull in and cause the motor to slow down whenever the swell shutters are in a nearly closed position.

Slowing of the motor is accomplished as follows: diodes 157 and 158 are connected to relay 155 and form a nonpolar diode network which reduces the applied voltage according to the number of diodes through which the current must pass, since each diode causes a fixed voltage drop of about 0.7 volts. Jumper connectors 160, shown in dotted line form, can optionally be connected to short out various diodes to make this voltage reducing diode network more or less effective, as required. Whenever the slow speed relay is in its unenergized position, the relay contacts 161 and 162 cause the complete diode network to be shorted out, and therefore ineffective, but when the slow speed relay is energized, these contacts are open and the diode network is made effective to slow the speed of the motor. This then, causes the motor to always run at slower speed when the shutters are in their nearly closed position, the exact point at which the slow down occurs being determined by the setting of potentiometer 147 at comparator 144.

There is a condition, however, when the shutters are near their closed position but it is not desireable to have the speed slowed. This is the condition where the imbalance is such that the swell shutters must move toward their open position, and when there is a large imbalance, meaning that the swell shoe is calling for the shutters to go to, for example, the fully opened condition. Under these conditions the shutters should not move slowly, but rather should proceed at high speed. To accomplish this, a circuit including the comparator 164 is provided. This comparator is a duplicate of comparator 106, except that the offset voltage as set by resistor 165 and potentiometer 166 is set to provide a larger off-set value. This means that the comparator 164 will only provide a positive voltage at its output terminal 167 whenever there is a large imbalance between the voltage from the cam position sensor and the voltage from the swell shoe potentiometer. In addition, imbalance must be in the negative direction, meaning that the shutters are to be moved toward the open position. Any positive voltage at terminal 167 is connected by means of diode 168 and resistor 169 to the input of switching transistor 170, which short-circuits the base of the slow speed transistor 153, thus inhibiting the operation of the slow speed relay under these conditions to insure that the motor will operate at full speed.

As has previously been described, dead-bands are provided for the purpose of avoiding the hunting and overshoot that would be present if absolute balance of the system was required. The dead-bands remove the need for absolute balance, and permit a limited amount of imbalance so that hunting will not occur. The need for this dead-band effect varies, depending upon the speed at which the system is operating. Generally speaking, if the shutters are moving rapidly, it means that they are not near their closed position, and/or that they are moving rapidly toward their open position. Since the exact stopping position is not critical when the shutters are nearly open, provision has been made for widening the dead-bands under these conditions and narrowing them when the system is moving in a slow speed mode, thus to achieve much greater precision of the operation of the entire system. This automatic dead-band adjustment is accomplished by means of the circuitry now to be described.

Resistor 171 and potentiometer 172 form an adjustable voltage divider for producing a voltage at 173 that is applied via diodes 174 and 175 to the inverting input 125 of comparator 118. This voltage is added to the voltage supplied by potentiometer 127, and serves to widen the dead-band of the comparator with respect to its width without this circuit. The output 150 of comparator 144 is connected through resistor 176 to the base of a transistor 177, and when the output 150 is positive, the transistor saturates and short circuits potentiometer 172 rendering the dead-band widening circuit ineffective.

Whenever the dead-band is to be widened, the voltage appearing at terminal 173 of the potentiometer 172 is also applied through diode 174 and resistor 178 to an inverter and level translater integrated circuit 179, which produces at its output terminal 180 a negative voltage having the same magnitude as the positive voltage appearing at terminal 173. This voltage is applied to the non-inverting input of the comparator 106 through diode 181 in order to widen the dead-band of comparator 106.

Diodes 182 form a diode voltage dropping network whereby the overall speed of the motor 11 can be adjusted to compensate for differences in the mass of the shutters and to compensate for differences in organ rectifier voltages. A switch 183 is arranged to permit one or more of the diodes to be shorted out to permit selected diode forward voltage drops to be used to reduce the voltage of the organ rectifier in 0.7 volt steps. 184 is an adjustable power resistor that is also in series with the motor 11, and provides an additional control of the motor speed. Whenever the motor is operating in its forward direction, which is the condition when the shutters are moving toward their closed position, adjustable resistor 185 is effective to permit adjustment of the motor speed for the purpose of supplying the motor with less power when conditions are such that a shutter return spring, or weight, is helping to accelerate the motor. Adjusting the resistor 185 thus makes it possible to equalize the opening and closing speeds of the shutters under such conditions.

Finally, contacts 187 and 188, when closed upon energization of the slow speed relay 155, place the resistor 189 across the motor 11, through diode 190. The purpose of this "speed retarder" circuit is to provide a moderate dynamic braking effect to cause the motor to slow down more quickly whenever the motor speed is changed from high to low. It also assists in slowing the motor when the motor is trying to be accelerated by the pull of a return spring or weight.

Although the present invention has been described in terms of a preferred embodiment, it will be understood that numerous variations can be made by those of skill in the art without departing from the true spirit and scope of the invention as defined in the following claims.

I claim:

1. An electronically controlled swell shutter operator for pipe organs, comprising:

drive motor means;

operator means responsive to the operation of said drive motor and adapted to drive a swell shutter;

first variable voltage means responsive to the position of said operator means, said first variable voltage means comprising a photocell having a resistance value proportional to the rotational position of said operator means for producing a first signal indicating the position of the swell shutter;

means for producing a second signal indicating a desired position for the swell shutter;

electronic circuit means including a plurality of integrated circuit comparators for sensing the magnitude and the direction of any imbalance between said first and second signals and for producing comparator output signals; and logic circuit means responsive to said comparator output signals for operating said drive motor in a selected direction at a selected speed to cause said drive motor to drive the swell shutter to the desired position.

2. The swell shutter operator of claim 1, wherein said means for producing said second signal comprises second variable voltage means responsive to the position of an organ swell controller.

3. The swell shutter operator of claim 2, wherein said second variable voltage means comprises potentiometer means.

4. The swell shutter operator of claim 2, wherein said second variable voltage means comprises a plurality of individually adjustable potentiometer circuits, switch means responsive to the position of said swell controller to select one of said potentiometer circuits, and output means for producing as said second signal a voltage proportioned to the setting of the particular potentiometer circuit selected by said switch means.

5. The swell shutter operator of claim 4, further including indicator means for each of said potentiometer circuits.

6. The swell shutter operator of claim 1, wherein said operator means includes speed reducer means connected to and driven by said drive motor, said speed reducer having an output shaft adapted for connection to a swell shutter.

7. The swell shutter operator of claim 6, wherein said drive motor is reversible to drive said speed reducer output shaft in a selected direction to open or close a swell shutter.

8. The swell shutter operator of claim 7, wherein said drive motor is a variable speed electric motor.

9. An electronically controlled swell shutter operator for pipe organs, comprising:

drive motor means;

operator means responsive to the operation of said drive motor and adapted to drive a swell shutter;

cam means responsive to the position of said operator means, cam follower means engaging said cam, and first variable resistance means responsive to the motion of said cam follower for producing a first signal indicating the position of the swell shutter;

means for producing a second signal indicating a desired position for the swell shutter;

electronic circuit means including a plurality of integrated circuit comparators for sensing the magnitude and the direction of any imbalance between said first and second signals and for producing comparator output signals; and logic circuit means responsive to said comparator output signals for operating said drive motor in a selected direction at a selected speed to cause said drive motor to drive the swell shutter to the desired position.

10. The swell shutter operator of claim 9, wherein said means for producing said second signal comprises second variable voltage means responsive to the position of an organ swell controller.

11. The swell shutter operator of claim 10, wherein said second variable voltage means comprises a plurality of individually adjustable potentiometer circuits, switch means responsive to the position of said swell controller to select one of said potentiometer circuits, and output means for producing as said second signal a voltage proportional to the setting of the particular potentiometer circuit selected by said switch means.

12. An electronically controlled swell shutter operator for pipe organs, comprising:

drive motor means;

operator means responsive to said drive motor adapted to drive a swell shutter;

first variable signal means responsive to the position of said operator means for producing a first signal;

second variable signal means for producing a second signal indicating a desired position for said operator means;

first comparator means responsive to said first and second variable signal means for producing a first error signal to activate said drive motor in a first direction of rotation;

second comparator means responsive to said first and second variable signal means for producing a second error signal to activate said drive motor in a second direction of rotation;

threshold means responsive to said first variable signal means for producing a speed control signal to vary the speed of rotation of said drive motor in accordance with the position of said operator means; and inhibitor means responsive to said first and second variable signal means for disabling said threshold means when said drive motor is energized in said first direction of rotation, whereby said drive motor is operated in a selectable direction at predetermined, variable speeds to drive said operator means, and a swell shutter connected thereto, to a desired position.

13. The swell shutter operator of claim 12, further including adjustable deadband means for each of said first and second comparator means, said deadband means prevent hunting of said drive motor.

14. The swell shutter operator of claim 13, wherein said circuit means further includes automatic deadband adjustment means for at least one of said first and second comparators.

15. The swell shutter of claim 13, wherein said deadband means is responsive to said threshold means for automatic adjustment of said deadband in accordance with the speed of rotation of said drive motor.

16. The swell shutter operator of claim 12, further including a dynamic braking circuit operative upon deactivation of said drive motor.

* * * * *